US007121095B2

(12) United States Patent
McMasters et al.

(10) Patent No.: US 7,121,095 B2
(45) Date of Patent: Oct. 17, 2006

(54) COMBUSTOR DOME ASSEMBLY OF A GAS TURBINE ENGINE HAVING IMPROVED DEFLECTOR PLATES

(75) Inventors: Marie Ann McMasters, Mason, OH (US); John Lawrence Vandike, Fairfield, OH (US); James Neil Cooper, Hamilton, OH (US); Michael Louis Vermeersch, Hamilton, OH (US); Duane Douglas Thomsen, Loveland, OH (US); Allen Michael Danis, Mason, OH (US)

(73) Assignee: General Electric Company, Schenectady, NY (US)

( * ) Notice: Subject to any disclaimer, the term of this patent is extended or adjusted under 35 U.S.C. 154(b) by 613 days.

(21) Appl. No.: 10/638,907

(22) Filed: Aug. 11, 2003

(65) Prior Publication Data

US 2005/0034461 A1 Feb. 17, 2005

(51) Int. Cl.
*F02C 1/00* (2006.01)

(52) U.S. Cl. ..... 60/746; 60/752

(58) Field of Classification Search ..... 60/752, 60/748, 737, 746, 755
See application file for complete search history.

(56) References Cited

U.S. PATENT DOCUMENTS

| | | | | |
|---|---|---|---|---|
| 4,763,482 | A | 8/1988 | Wehner | 60/746 |
| 5,396,759 | A * | 3/1995 | Richardson | 60/804 |
| 5,916,142 | A | 6/1999 | Snyder et al. | 60/748 |
| 6,314,739 | B1 * | 11/2001 | Howell et al. | 60/748 |
| 6,363,726 | B1 | 4/2002 | Durbin et al. | 60/748 |
| 6,381,964 | B1 | 5/2002 | Pritchard, Jr. et al. | 60/746 |
| 6,418,726 | B1 | 7/2002 | Foust et al. | 60/776 |
| 6,427,435 | B1 | 8/2002 | Patterson et al. | 60/39.32 |
| 6,434,926 | B1 * | 8/2002 | Dean et al. | 60/804 |
| 6,453,671 | B1 | 9/2002 | Leen et al. | 60/748 |
| 6,484,489 | B1 | 11/2002 | Foust et al. | 60/39.06 |
| 6,571,559 | B1 | 6/2003 | Fortuna et al. | 60/748 |
| 6,976,363 | B1 * | 12/2005 | McMasters et al. | 60/800 |

* cited by examiner

*Primary Examiner*—Charles G. Freay
(74) *Attorney, Agent, or Firm*—William Scott Andes; James P. Davidson, Esq.

(57) ABSTRACT

A combustor dome assembly for a gas turbine engine having a longitudinal centerline axis extending therethrough, including: an annular dome plate having an inner portion, an outer portion, a forward surface, and a plurality of circumferentially spaced openings formed therein, wherein a radial section defined between each of the openings includes a cooling trough formed therein; an outer cowl connected to the dome plate outer portion at a downstream end thereof; an inner cowl connected to the dome plate inner portion at a downstream end thereof; and, a deflector plate connected to and positioned aft of each opening in the dome plate. Each deflector plate further includes: an annular section at an upstream end thereof having a forward end, an aft end, an inner surface and an outer surface; a substantially planar flange connected to the aft end of the annular section, the planar flange including an outer circumferential surface, an inner circumferential surface, a first radial surface, a second radial surface, and an opening therein sized to the inner surface of the annular section so as to form opposing radial sections; a first flange connected to the outer circumferential surface of the planar flange at a predetermined angle thereto; and, a second flange connected to the inner circumferential surface of the planar flange at a predetermined angle thereto. The first and second radial sections of the deflector plate planar flange are configured so at least a portion of the dome plate cooling trough is in flow communication with a combustion chamber downstream of said dome plate.

29 Claims, 9 Drawing Sheets

COMBUSTOR DOME ASSEMBLY OF A GAS TURBINE ENGINE HAVING IMPROVED DEFLECTOR PLATES

BACKGROUND OF THE INVENTION

The present invention relates generally to a combustor dome assembly for a gas turbine engine and, in particular, to a combustor dome assembly including deflector plates which are configured to limit stress imposed thereon. Further, a dome plate for the combustor dome assembly is provided which has a cooling trough in each radial section with purge openings that are substantially aligned with a radial surface of such deflector plates.

It is well known within the combustor art of gas turbine engines that a dome portion, in conjunction with inner and outer liners, serves to form the boundary of a combustion chamber. A mixture of fuel and air is ignited and burned in such combustion chamber so that the products thereof are able to interface with the blades of turbines and produce work through one or more shafts. The annular combustor dome also serves to position a plurality of mixers in a circumferential manner so that a fuel/air mixture is provided to the combustion chamber in a desired manner.

While the typical combustor arrangement has adequate space between swirler cups to incorporate features to enhance the spectacle plate structure (e.g., the addition of ribs, cooling holes and the like), certain geometric restrictions have been introduced by current combustor designs which run lean so as to minimize emissions. As disclosed in U.S. Pat. No. 6,381,964 to Pritchard, Jr. et al., one particular fuel/air mixer configuration includes a fuel nozzle containing a pilot mixer therein. The fuel nozzle is then located within a main mixer. Accordingly, the size of the fuel nozzle and the corresponding swirler assembly associated therewith has increased significantly from those previously utilized and thereby reduced the distance between adjacent swirler cups. Utilization of an annular dome plate having a greater diameter would serve to increase the weight of the engine and require modification of components interfacing therewith. Thus, the openings in the dome plate have been enlarged and thereby lessened the circumferential distance between adjacent openings.

It will be appreciated that a plurality of deflector plates are generally provided in the combustor dome assembly. Such deflector plates are connected to the dome plate adjacent each opening therein in circumferentially spaced relation and protects the dome plate from the extreme effects of the combustion chamber. Cooling for the side edges of the deflector plates is accomplished by means of cooling holes positioned in a radial section of the dome plate between adjacent openings. It has been found, however, that the proximity of adjacent deflector plates and the relatively thin radial sections thereof has created additional stresses which have created deformation and cracking along portions thereof.

Thus, in light of the foregoing, it would be desirable for a combustor dome assembly to be developed which accommodates minimum spacing between adjacent swirler cups. It would also be desirable for a deflector plate to be developed which is configured to limit the stresses imposed thereon. Another desirable feature of the combustor dome assembly is a dome plate which can provide additional purge air to certain regions of the deflector plate while advantageously affecting the temperature and mixture of the fuel and air in the combustion chamber adjacent thereto.

BRIEF SUMMARY OF THE INVENTION

In a first exemplary embodiment of the invention, a combustor dome assembly for a gas turbine engine is disclosed as having a longitudinal centerline axis extending therethrough. The combustor dome assembly includes: an annular dome plate having an inner portion, an outer portion, a forward surface, and a plurality of circumferentially spaced openings formed therein, wherein a radial section defined between each of the openings includes a cooling trough formed therein; an outer cowl connected to the dome plate outer portion at a downstream end thereof; an inner cowl connected to the dome plate inner portion at a downstream end thereof; and, a deflector plate connected to and positioned aft of each opening in the dome plate. Each deflector plate further includes: an annular section at an upstream end thereof having a forward end, an aft end, an inner surface and an outer surface; a substantially planar flange connected to the aft end of the annular section, the planar flange including an outer circumferential surface, an inner circumferential surface, a first radial surface, a second radial surface, and an opening therein sized to the inner surface of the annular section so as to form opposing radial sections; a first flange connected to the outer circumferential surface of the planar flange at a predetermined angle thereto; and, a second flange connected to the inner circumferential surface of the planar flange at a predetermined angle thereto. The first and second radial sections of the deflector plate planar flange are configured so at least a portion of the dome plate cooling trough is in flow communication with a combustion chamber aft of the dome plate.

In a second exemplary embodiment of the invention, a deflector plate for a gas turbine engine combustor is disclosed as having a longitudinal centerline axis therethrough. The deflector plate includes: an annular section at an upstream end thereof having a forward end, an aft end, an inner surface and an outer surface; a substantially planar flange connected to the aft end of the annular section, the planar flange including an outer circumferential surface, an inner circumferential surface, a first radial surface, a second radial surface, and an opening therein sized to the inner surface of the annular section so as to form opposing radial sections; a first flange connected to the outer circumferential surface of the planar flange at a predetermined angle thereto; and, a second flange connected to the inner circumferential surface of the planar flange at a predetermined angle thereto. The first and second radial sections include a notched portion therein so as to reduce stress imposed on the radial sections of the planar flange.

In a third embodiment of the present invention, an annular dome plate for a gas turbine engine combustor is disclosed as having a longitudinal centerline axis therethrough. The dome plate includes an inner portion, an outer portion, and a middle portion located between the inner and outer portions, wherein a plurality of circumferentially spaced openings are formed in the middle portion. The middle portion further includes a radial section defined between each of the openings, as well as a cooling trough formed in each radial section having a plurality of cooling holes formed therein and at least one purge opening of substantially greater size than the cooling holes formed therein.

DETAILED DESCRIPTION OF THE INVENTION

Figure 1:
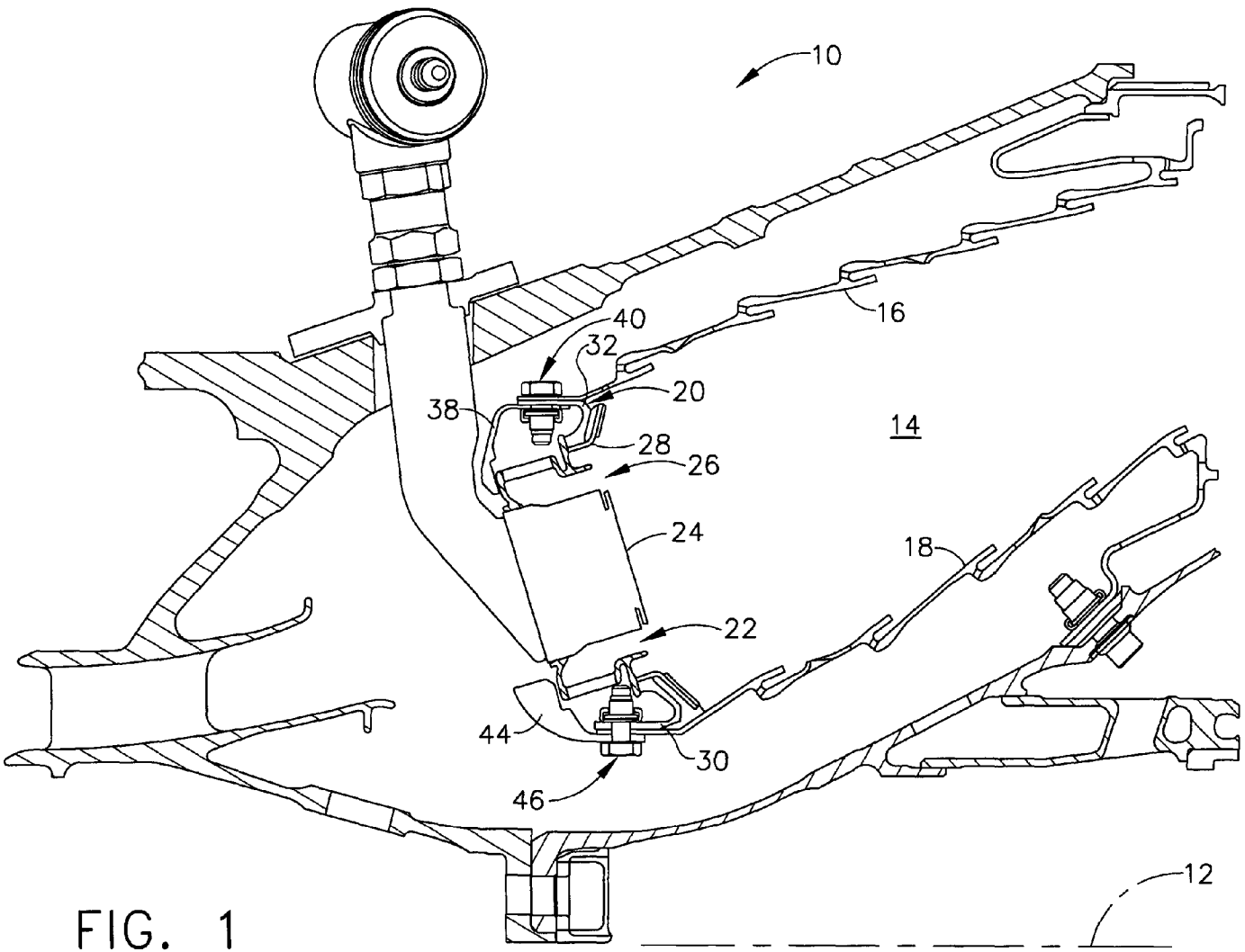
FIG. 1 is a cross-sectional view of a gas turbine engine combustor including a combustor dome assembly of the present invention.
Figure 2:
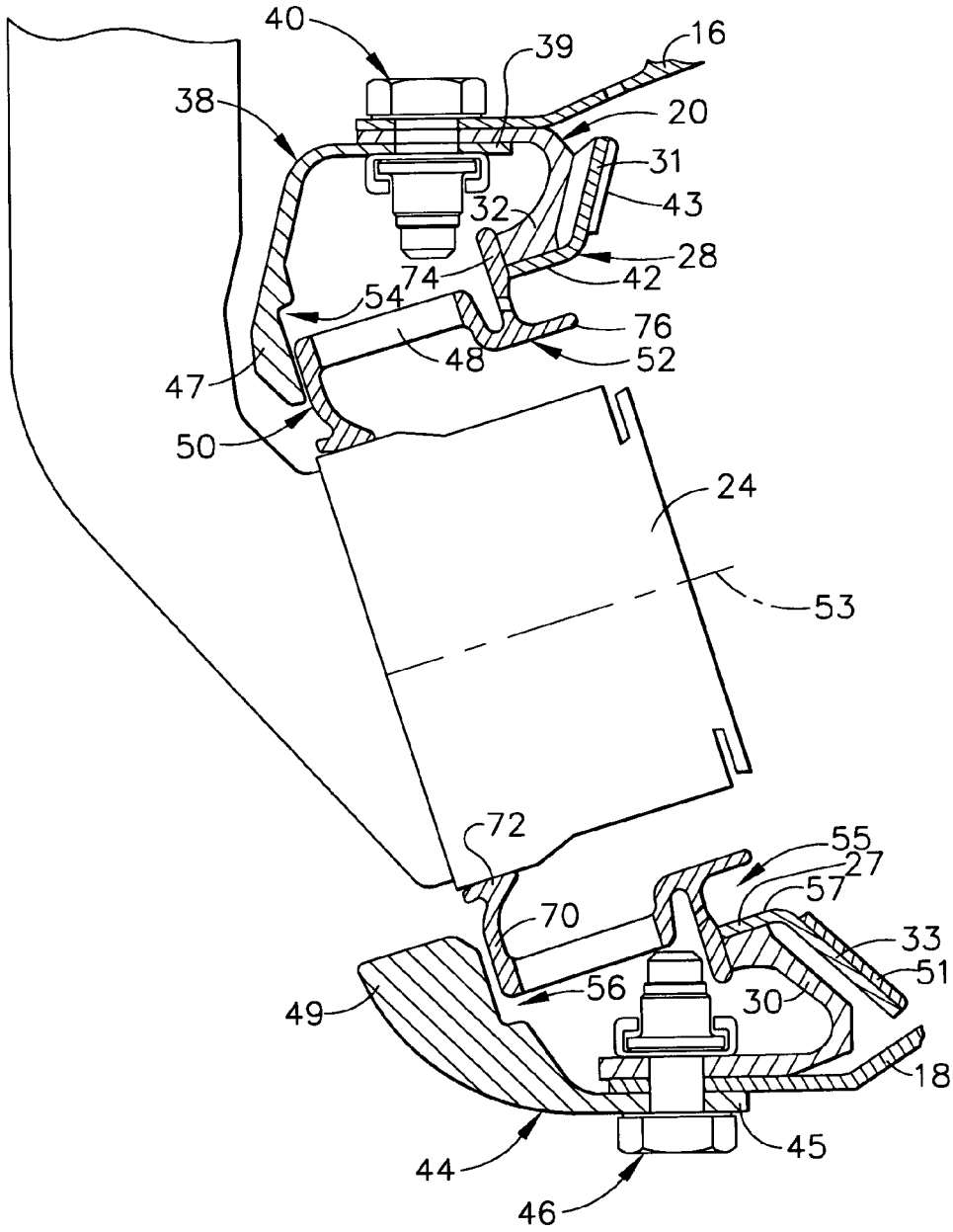
FIG. 2 is an enlarged, partial cross-sectional view of the combustor dome assembly depicted in FIG. 1.

Referring now to the drawings in detail, wherein identical numerals indicate the same elements throughout the figures, FIG. 1 depicts an exemplary gas turbine engine combustor 10 having a longitudinal centerline axis 12 extending therethrough. Combustor 10 includes a combustion chamber 14 defined by an outer liner 16, an inner liner 18, and a dome plate 20 located at an upstream end thereof. It will be understood that a plurality of fuel/air mixers 22 are circumferentially spaced within dome plate 20 so as to introduce a mixture of fuel and air into combustion chamber 14, where it is ignited by an igniter (not shown) and combustion gases are formed which are utilized to drive one or more turbines downstream thereof. More specifically, each air/fuel mixer 22 preferably includes a fuel nozzle 24, a swirler 26, and a deflector plate 28.

Figure 3:
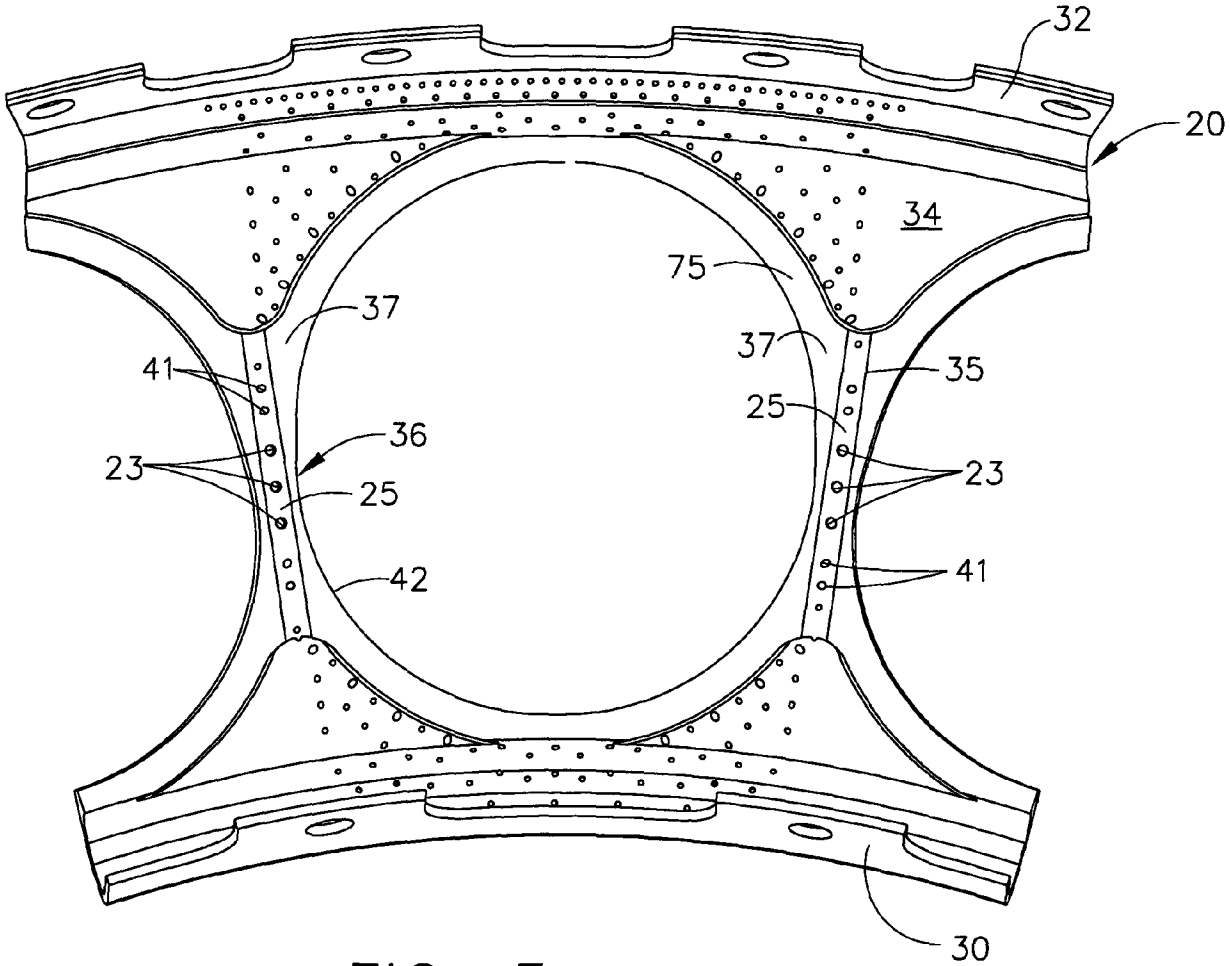
FIG. 3 is an enlarged, partial forward view of a dome plate for the combustor dome assembly depicted in FIGS. 1 and 2.

More specifically, it will be understood that dome plate 20 is annular in configuration and includes an inner portion 30, an outer portion 32, a forward surface 34 and a plurality of circumferentially spaced openings 36 formed therein (see FIG. 3). Accordingly, a radial section 37 is defined between each adjacent openings 36 in dome plate 20. As discussed herein, each opening 36 preferably has at least a predetermined diameter in dome plate 20 so that a circumferential distance (defined by radial sections 37) between adjacent openings 36 in dome plate 20 is no greater than a predetermined amount. It will be seen in FIG. 3 that each radial section 37 preferably includes a cooling area or trough 35 having a plurality of cooling holes 41 formed therein. As described in greater detail herein, cooling trough 35 preferably includes at least one purge opening 23 located within a middle portion 25 thereof. An annular outer cowl 38 is affixed to outer portion 32 of dome plate 20 at a downstream end 39, as well as to outer liner 16, by means of a plurality of connections 40 (e.g., bolts and nuts). Similarly, an annular inner cowl 44 is affixed to inner portion 30 of dome plate 20 at a downstream end 45, as well as inner liner 18, by means of a plurality of connections 46 (bolts and nuts).

Figure 4:
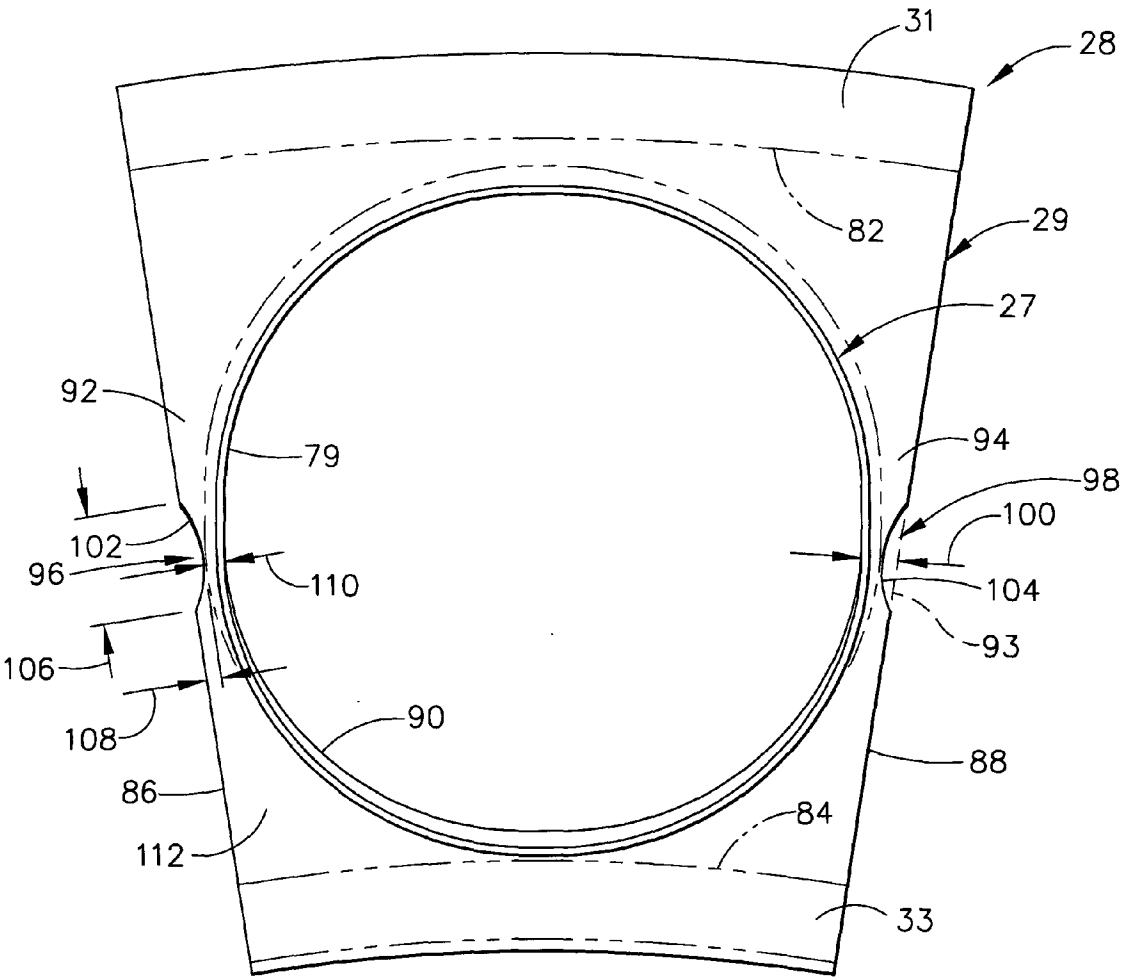
FIG. 4 is an enlarged, forward view of a deflector plate for the combustor dome assembly depicted in FIGS. 1 and 2.

Deflector plates 28 are associated with each opening 36 in dome plate 20 and therefore are spaced in circumferential manner therearound. Each deflector plate 28 is preferably attached to dome plate 20 by means of brazing or the like. More specifically, deflector plates 28 each include a generally annular section 27 at an upstream end thereof having a forward end 77, an aft end 78, an inner surface 79, and an outer surface 80 (see FIGS. 4 and 5). It will be appreciated that annular section 27 is sized so that outer surface 80 is positioned within an inner surface 42 of dome plate openings 36. A generally planar flange 29 extends from aft end 78 of annular section 27 and has a an outer circumferential surface 82, an inner circumferential surface 84, a first radial surface 86, a second radial surface 88, and an opening 90 formed therein. It will be seen that opening 90 is sized to inner surface 79 of annular section 27 so that opposing radial sections 92 and 94 are formed.

Further, a first flange 31 is connected to outer circumferential surface 82 of planar flange 29 at a predetermined angle and a second flange 33 is similarly connected to inner circumferential surface 84 of planar flange 29 at a predetermined angle. First and second angled flanges 31 and 33 are configured so as to extend adjacent to outer and inner dome portions 32 and 30, respectively. A thermal barrier coating is preferably applied to at least a portion of angled flanges 31 and 33, as identified by reference numerals 43 and 51.

In order to limit the stresses imposed upon deflector plates 28, a portion 93 (identified in phantom with respect to radial section 94) has been removed from radial sections 92 and 94 so that notched portions 96 and 98, respectively, are defined. It will be seen that notched portions 96 and 98 are preferably located where radial sections 92 and 94 have a minimum circumferential length identified by reference numeral 100. Notched portions 96 and 98 are also preferably substantially semi-circular in shape so that first and second radial surfaces 86 and 88 include an arcuate portion 102 and 104, respectively. It will be noted that each portion 96 and 98 preferably has a predetermined radial length 106 (approximately 5–25% of radial surfaces 86 and 88) and a predetermined circumferential length 108 (approximately 70–90% of circumferential length 100 for radial sections 37). Accordingly, radial sections 92 and 94 will maintain a minimum circumferential length 110 (approximately 10–30% of circumferential length 100).

Figure 5:
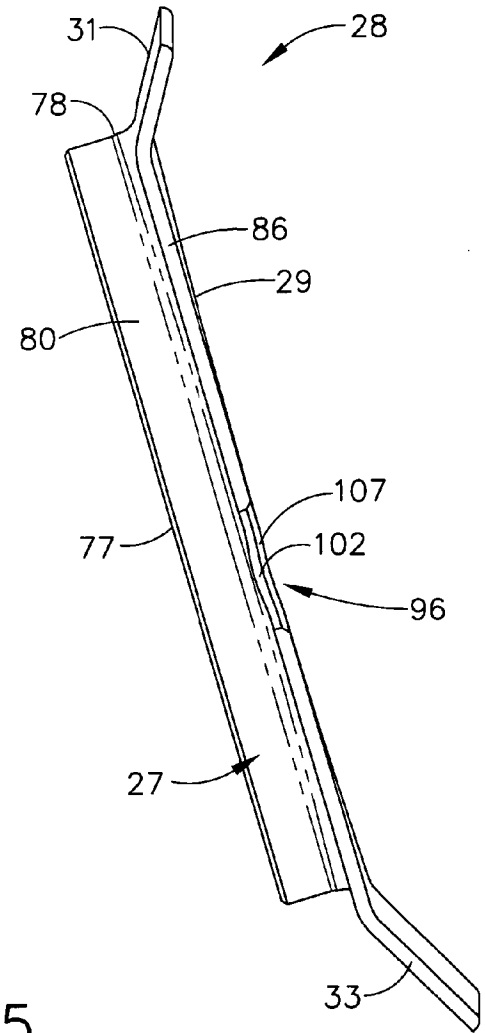
FIG. 5 is a side perspective view of the deflector plate depicted in FIG. 4.
Figure 6:
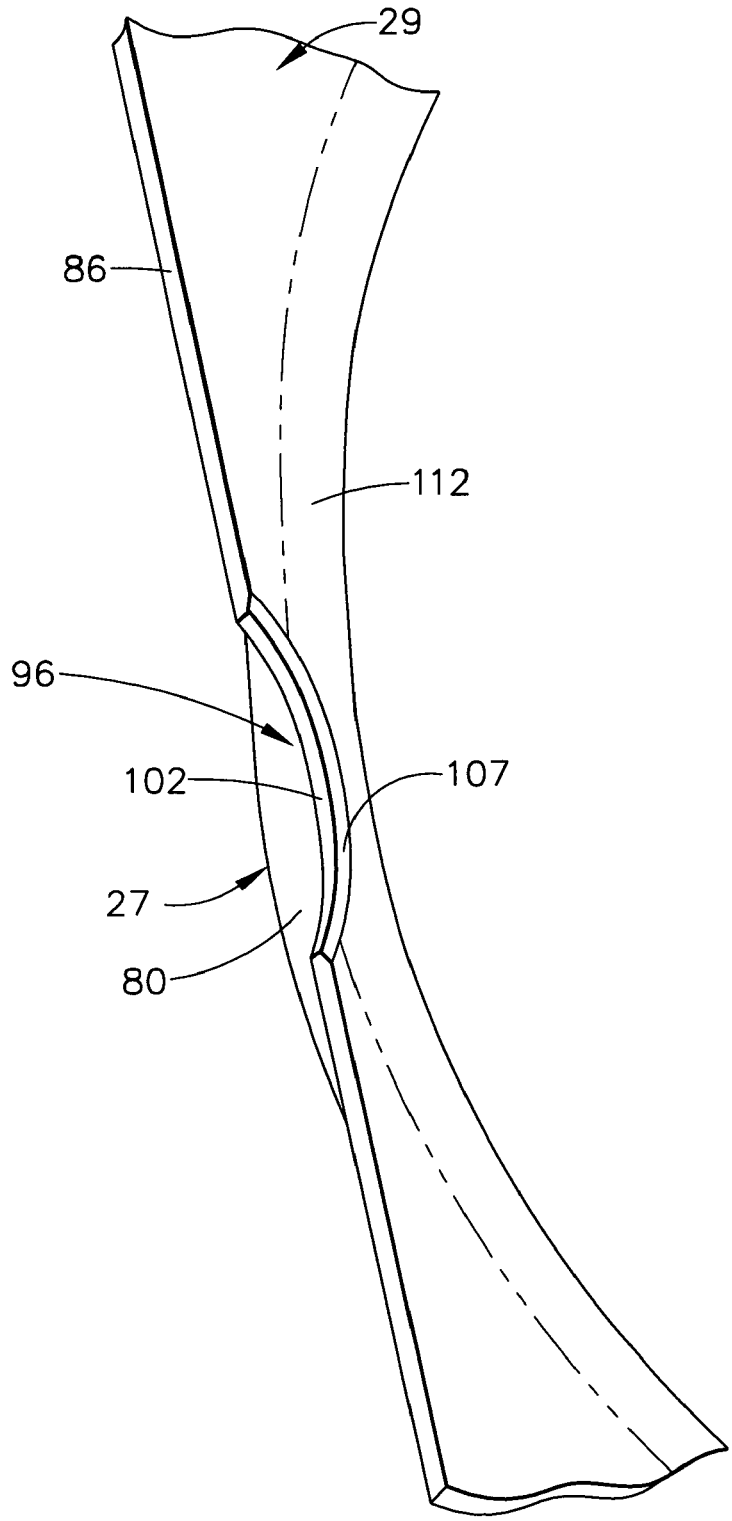
FIG. 6 is an enlarged, partial perspective view of the deflector plate depicted in FIGS. 4 and 5.

It is also preferred that arcuate portions 102 and 104 be configured so as to be nonplanar. As best seen in FIGS. 5 and 6, such arcuate portions 102 and 104 preferably include a chamfer (identified by reference numeral 107 with respect to radial surface portion 102) formed by radial surfaces 86/88 and aft surface 112 of planar flange 29. Aft surface 112 is preferably oriented at an angle of approximately 35–55° with respect to radial surfaces 86 and 88 to form chamfer 107. In this way, improved durability is provided to deflector plate 28, as well as improved adherence of a thermal barrier coating.

Figure 7:
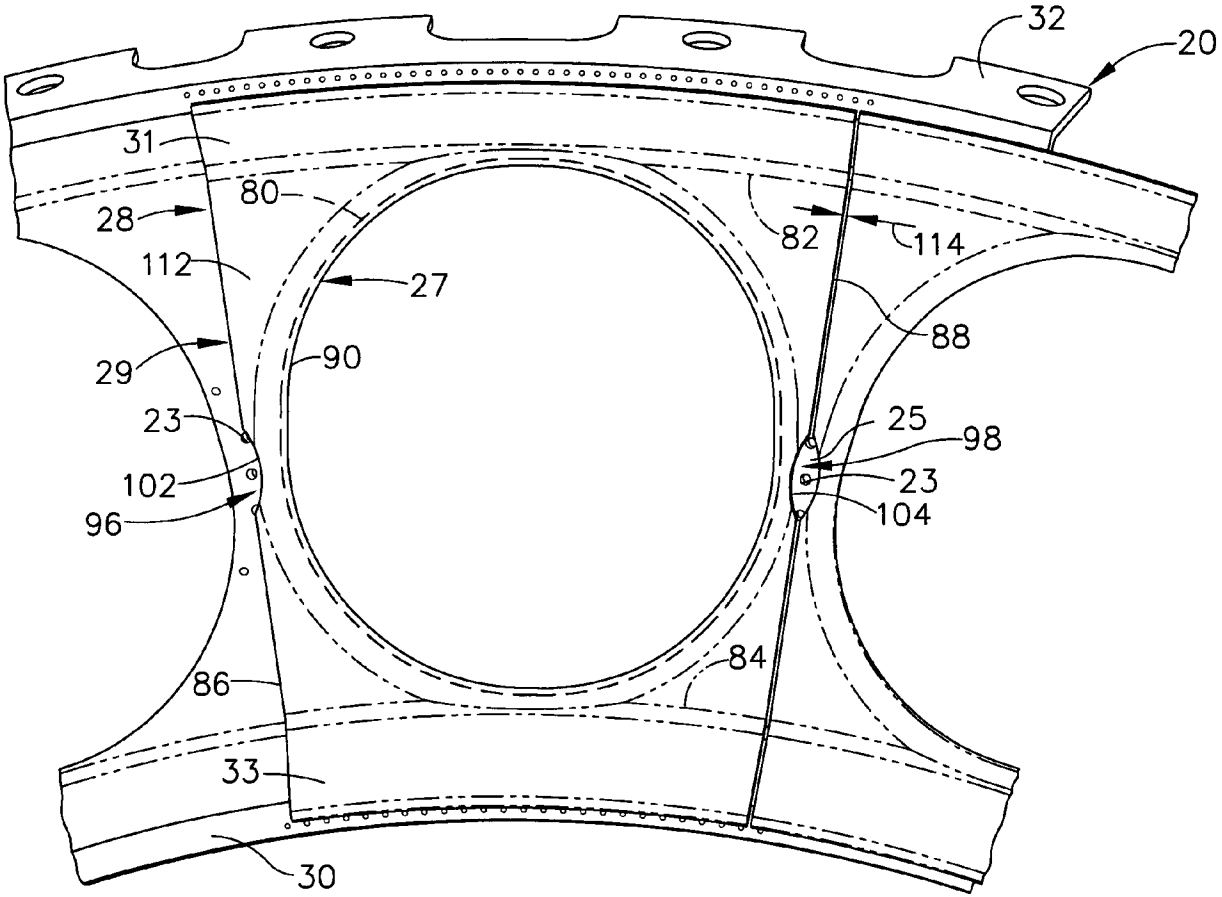
FIG. 7 is a partial aft view of the dome plate depicted in FIG. 3 with the deflector plate depicted in FIGS. 4 and 5 positioned adjacent thereto and in alignment with an opening in the dome plate, where the combustor dome assembly is in a relatively cold operative state.
Figure 8:
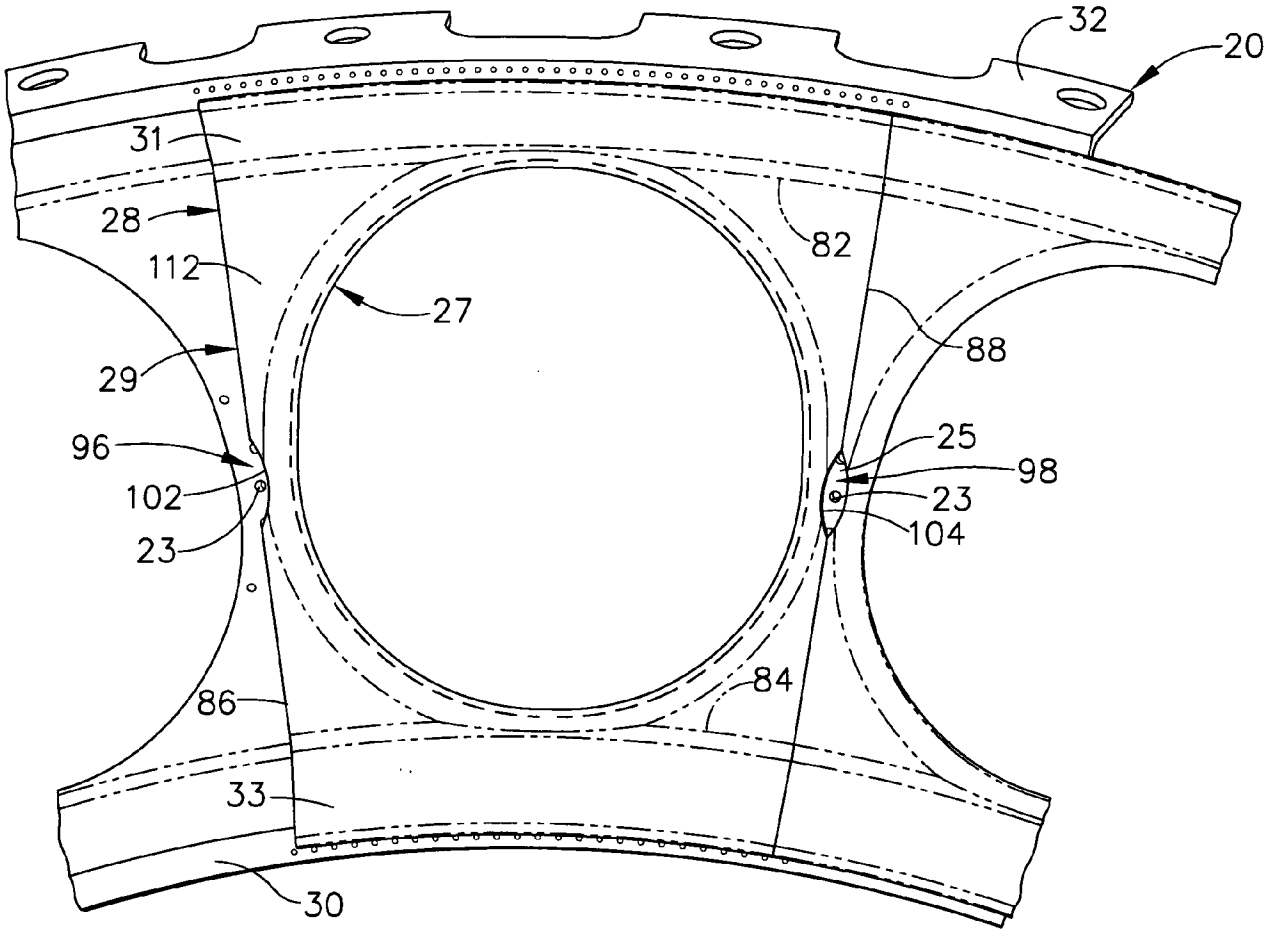
FIG. 8 is a partial aft view of the dome plate depicted in FIG. 3 with the deflector plate depicted in FIGS. 4 and 5 positioned adjacent thereto and in alignment with an opening in the dome plate, where the combustor dome assembly is in a relatively hot operative state; and, FIG. 9 is a partial aft view of a dome plate having an alternative configuration with the deflector plate depicted in FIGS. 4 and 5 positioned adjacent thereto and in alignment with an opening in such dome plate.

With respect to purge openings 23 formed in middle portion 25 of cooling trough 35, it will be appreciated from FIGS. 3, 6 and 7 that such purge openings 23 are substantially circular in shape. It will be understood that the depiction of deflector plates 28 and dome plate 20 in FIG. 7 reflects the relative positioning of adjacent deflector plates 28 during a relatively cold state of combustor dome assembly 10. Thus, a slight gap 114 exists between such deflector plates 28 to allow for thermal growth. Purge openings 23 in cooling trough middle portion 25 are located so as to align with notch portions 96 and 98 so that air is permitted to flow therethrough in flow communication with combustion chamber 14 aft of dome plate 20 with minimum pressure loss. Although slightly obstructed due to the thermal growth of deflector plates 28, FIG. 8 depicts the flow communication through purge openings 23 into combustion chamber 14 during a relatively hot state for of combustor dome assembly 10.

In this way, it will be appreciated that cooling air flow from purge openings 23 are aligned with certain hot spots located between adjacent swirler cups. This serves to dilute the fuel/air ratio significantly and reduce the local temperature and formation of NOx at such locations. Moreover, air flowing through purge openings 23 convectively cools arcuate portions 102 and 104 of deflector plate radial surfaces 86 and 88 (where thermal barrier coating is not applied), as well as purges a cavity formed by notched portions 96 and 98 to prevent ingestion of hot combustion products.

Figure 9:
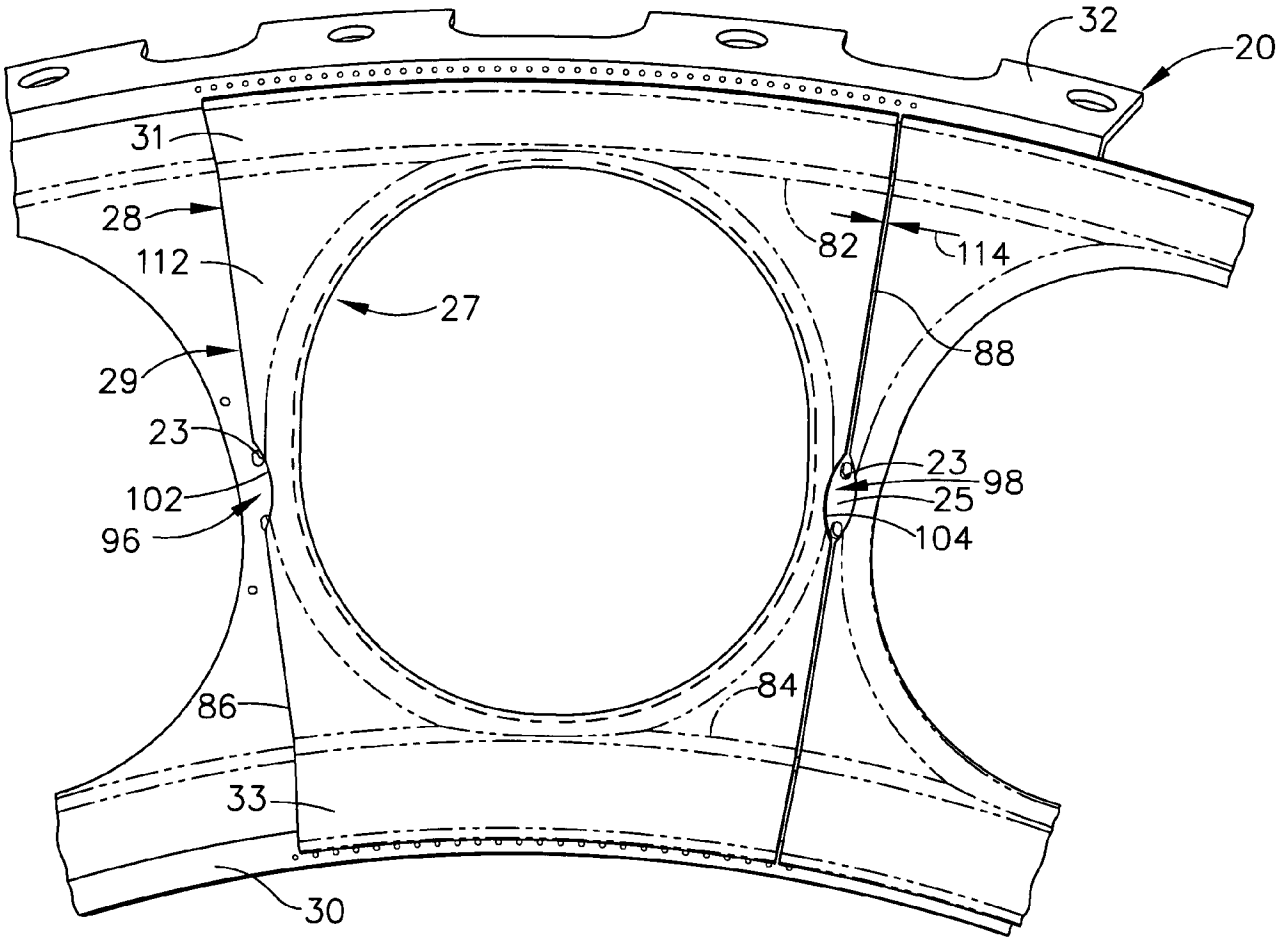

It will further be understood from FIG. 9, that purge openings 23 may be an oval, slot or any other desired shape. Nevertheless, purge openings 23 will preferably have no more than a predetermined collective area therefor (preferably no greater than the area of notched portions 96 and 98) so as to strike a balance between performing its desired functions and any undesirable effects on the combustion process. Purge openings 23 will preferably have at least twice the diameter of cooling holes 41 with a minimum spacing therebetween equivalent to about twice the diameter thereof. Accordingly, the actual size and spacing of purge openings 23 adjusted according to the size of notched portions 96 and 98.

Fuel nozzle 24 is preferably of the type disclosed in U.S. Pat. No. 6,381,964 to Pritchard, Jr. et al., which is hereby incorporated by reference. It will be appreciated that fuel nozzle 24 is larger than typical fuel nozzles and therefore requires larger openings 36 in dome plate 20. Accordingly, each opening 36 in dome plate 20 has at least a predetermined diameter (approximately at least three times larger than prior dome plate openings), where a circumferential distance 64 between openings 36 (i.e., that of radial sections 37) is no greater than a predetermined amount (approximately one-third or less than that in prior dome plates).

Each swirler 26 is located between forward surface 34 of dome plate 20 and upstream ends 47 and 49 of outer and inner cowls 38 and 44, respectively, so as to be in substantial alignment with an opening 36 in dome plate 20. Further, each swirler 26 includes a forward portion 50 and an aft portion 52. It will be appreciated that swirlers 26 are not fixed or attached to any other component of air/fuel mixer 22, but are permitted to float freely in both a radial and axial direction with respect to a centerline axis 53 through each opening 36. Each swirler 26 preferably includes vanes 48 therein which are oriented to provide swirl in a substantially radial direction with respect to centerline axis 53.

It will be seen that swirler forward portion 50 preferably includes a radial flange 70 which moves between first and second tab members 54 and 56 associated with outer and inner cowls 38 and 44, respectively, as disclosed in a patent application entitled "Combustor Dome Assembly Of A Gas Turbine Engine Having A Free Floating Swirler." Such patent application, having Ser. No. 10/638,597, is filed concurrently herewith, is also owned by the assignee of the present invention, and is hereby incorporated by reference. Swirler forward portion also includes an axial section 72 for receiving fuel nozzle 24. Anti-rotation members (not shown) are provided on a forward surface of axial section 72 to engage with those of adjacent swirlers and thereby prevent swirlers 26 from spinning.

Swirler aft portion 52 preferably includes a flange 74 which is able to slide radially along a boss section 75 of dome plate forward surface 34. A lip 76 is connected to flange 74 and is preferably oriented substantially perpendicular to flange 74 so that it is substantially parallel to centerline axis 53. It will be noted that lip 76 extends aft of dome plate forward surface 34 so that it interfaces with annular section 27 of deflector plate 28 and thereby limits radial movement of swirler 26. Flange 74 of swirler aft portion 52 is preferably contoured as described in a patent application entitled "Combustor Dome Assembly Having A Contoured Swirler," which is filed concurrently herewith. Such patent application, having Ser. No. 10/638,506, is also owned by the assignee of the present invention and is hereby incorporated herein by reference.

Having shown and described the preferred embodiment of the present invention, further adaptations of the combustor dome assembly, as well as the deflector plates and the dome plate thereof can be accomplished by appropriate modifications by one of ordinary skill in the art without departing from the scope of the invention.

What is claimed is:

1. A combustor dome assembly for a gas turbine engine having a longitudinal centerline axis extending therethrough, comprising:

(a) an annular dome plate having an inner portion, an outer portion, a forward surface, and a plurality of circumferentially spaced openings formed therein, wherein a radial section defined between each of said openings includes a cooling trough formed therein; and, (b) an outer cowl connected to said dome plate outer portion at a downstream end thereof;

(c) an inner cowl connected to said dome plate inner portion at a downstream end thereof; and, (d) a deflector plate connected to and positioned aft of each said opening in said dome plate, each deflector plate further comprising:

(1) an annular section at an upstream end thereof having a forward end, an aft end, an inner surface and an outer surface;

(2) a substantially planar flange connected to said aft end of said annular section, said planar flange including an outer circumferential surface, an inner circumferential surface, a first radial surface, a second radial surface, and an opening therein sized to said inner surface of said annular section so as to form opposing first and second radial sections;

(3) a first flange connected to said outer circumferential surface of said planar flange at a predetermined angle thereto; and, (4) a second flange connected to said inner cicumuferential surface of said planar flange at a predetermined angle thereto;

wherein said first and second radial sections of said deflector plate planar flange are configured so at least a portion of each said dome plate cooling trough is in flow communication with a combustion chamber aft of said dome plate.

2. The combustor dome assembly of claim 1, each cooling trough of said dome plate including at least one purge opening formed in a middle portion thereof which is substantially larger in diameter than a plurality of cooling holes fanned in said cooling trough.

3. The combustor dome assembly of claim 2, wherein a collective sits of said purge openings is equivalent to a predetermined amount.

4. The combustor dome assembly of claim 1, wherein said first and second radial sections of said deflector plate planar flange have a notched portion farmed therein so as to reduce stress imposed thereon.

5. The combustor dome assembly of claim 4, wherein said notched portions in said first and second radial sections are located at a point having a minimum circumferential length.

6. The combustor dome assembly of claim 4, wherein said notched portions in said first and second radial sections are substantially arcuate.

7. The combustor dome assembly of claim 4, wherein said notched portions in said first and second radial sections have a predetermined radial length.

8. The combustor dome assembly of claim 4, wherein said notched portions in said first and second radial sections have a predetermined circumferential length.

9. The combustor dome assembly of claim 4, wherein said first and second radial sections maintain a minimum circumferential length as said notched portions.

10. The deflector plate of claim 4, wherein radial surfaces of said planar flange are configured where said notched portions in said first and second radial sections are nonlinear.

11. The deflector plate of claim 10, wherein said notched portions in said first and second radial sections include a chamfer.

12. The deflector plate of claim 11, wherein said chamfer is formed in conjunction with said aft surface of said planar flange.

13. A deflector plate for a gas turbine engine combustor having a longitudinal centerline axis therethrough, comprising:

(a) an annular section at an upstream end thereof having a forward end, an aft end, an inner surface and an outer surface;

(b) a substantially planar flange connected to said aft end of said annular section, said planar flange including an outer circumferential surface, an inner circumferential surface, a flit radial surface, a second radial surface, and an opening therein sized to said inner surface of said annular section so as to form opposing first and second radial sections;

(c) a first flange connected to said outer circumferential surface of said planar flange at a predetermined angle thereto; and, (d) a second flange connected to said inner circumferential surface of said planar flange at a predetermined angle thereto;

wherein said first and second radial sections include a notched portion so as to reduce stress imposed on said radial sections of said planar flange.

14. The deflector plate of claim 13, wherein said notched portions in said first and second radial sections are located at a point having a minimum circumferential length.

15. The deflector plate of claim 13, wherein said notched portions in said first and second radial sections are substantially arcuate.

16. The deflector plate of claim 13, wherein said notched portions in said first and second radial sections have a predetermined radial length.

17. The deflector plate of claim 13, wherein said notched portions in said first and second radial sections have a predetermined circumferential length.

18. The deflector plate of claim 13, wherein said first and second radial sections maintain a minimum circumferential length at said notched portions.

19. The deflector plate of claim 13, wherein radial surfaces of said planar flange are configured where said notched portions in said first and second radial sections are nonlinear.

20. The deflector plate of claim 19, wherein said notched portions in said first and second radial sections include a chamfer.

21. The deflector plate of claim 20, wherein said chamfer is formed in conjunction with said aft surface of said planar flange.

22. The deflector plate of claim 13, wherein a thermal barrier coating is applied to an aft surface of said outer and inner radial flanges.

23. An annular dome plate for a gas turbine engine combustor having a longitudinal centerline axis therethrough, comprising:

(a) an inner portion;

(b) an outer portion; and, (c) a middle portion located between said inner and outer portions, wherein a plurality of circumferentially spaced openings are formed in said middle portion, said middle portion further comprising:

(1) a radial section defined between each of said openings; and (2) a cooling trough formed in each radial section having a plurality of cooling holes formed therein and at least one purge opening of substantially greater size than said cooling holes formed therein.

24. The dome plate of claim 23, wherein each opening in said dome plate has at least a predetermined diameter.

25. The dome plate of claim 23, wherein a circumferential distance between adjacent openings in said dome plate is no greater than a predetermined amount.

26. The dome plate of claim 23, wherein said purge openings are formed in a middle portion of said cooling trough.

27. The dome plate of claim 23, wherein said purge openings are substantially circular.

28. The dome plate of claim 23, wherein said purge openings are substantially ovular.

29. The dome plate of claim 23, wherein said purge openings have a predetermined collective area.

* * * * *

UNITED STATES PATENT AND TRADEMARK OFFICE

CERTIFICATE OF CORRECTION

PATENT NO. : 7,121,095 B2
APPLICATION NO. : 10/638907
DATED : October 17, 2006
INVENTOR(S) : Marie Ann McMasters et al.

It is certified that error appears in the above-identified patent and that said Letters Patent is hereby corrected as shown below:

Col. 6, Line 64
Claim 2, line 5: delete “fanned” and substitute --formed.--

Col. 6, Line 66
Claim 3, line 2: delete “sits” and substitute --area--.

Col. 7, Line 3
Claim 4, line 3: delete “farmed” and substitute --formed--.

Col. 7, Line 19
Claim 9, line 3: delete “as” and substitute --at--.

Col. 7, Line 38
Claim 13, line 10: delete “flit” and substitute --first--.

Signed and Sealed this

Twenty-sixth Day of December, 2006

JON W. DUDAS
*Director of the United States Patent and Trademark Office*